US011742131B2

(12) United States Patent
Kang et al.

(10) Patent No.: US 11,742,131 B2
(45) Date of Patent: Aug. 29, 2023

(54) COIL COMPONENT

(71) Applicant: SAMSUNG ELECTRO-MECHANICS CO., LTD., Suwon-si (KR)

(72) Inventors: Byung Soo Kang, Suwon-si (KR); Yong Hui Li, Suwon-si (KR); Seung Mo Lim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 457 days.

(21) Appl. No.: 17/096,174

(22) Filed: Nov. 12, 2020

(65) Prior Publication Data

US 2022/0013277 A1 Jan. 13, 2022

(30) Foreign Application Priority Data

Jul. 8, 2020 (KR) ..... 10-2020-0083863

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/12*** | (2006.01) |
| ***H01F 41/04*** | (2006.01) |
| ***H01F 27/32*** | (2006.01) |

(52) U.S. Cl.

CPC ..... *H01F 27/2804* (2013.01); *H01F 27/29* (2013.01); *H01F 27/32* (2013.01); *H01F 41/041* (2013.01); *H01F 41/12* (2013.01); *H01F 2027/2809* (2013.01)

(58) Field of Classification Search

CPC ..... H01F 27/2804
USPC ..... 336/200, 223, 232
See application file for complete search history.

(56) References Cited

U.S. PATENT DOCUMENTS 6,946,945 B2 * 9/2005 Sato ..... H01G 4/06 336/200
2013/0120900 A1 5/2013 Chung et al.
(Continued)

FOREIGN PATENT DOCUMENTS

KR 10-2013-0053878 A 5/2013
KR 10-2014-0012321 A 2/2014
(Continued)

*Primary Examiner* — Ronald Hinson
(74) *Attorney, Agent, or Firm* — Morgan, Lewis & Bockius LLP

(57) ABSTRACT

A coil component includes a body, a coil portion disposed inside the body, a first external electrode and a second external electrode spaced apart from each other on one surface of the body and connected to the coil portion, a first insulating layer and a second insulating layer respectively connected to the one surface of the body, respectively disposed to side surfaces of the body to extend upwardly of the one surface of the body, and a third insulating layer and a fourth insulating layer respectively connected to the one surface of the body, respectively disposed on end surfaces of the body and each extending upwardly of the one surface of the body. A portion of each of the first and second external electrodes, exposed from the first to fourth insulating layers, is spaced apart from each of a plurality of edges of the one surface of the body.

20 Claims, 8 Drawing Sheets

(56) References Cited

U.S. PATENT DOCUMENTS

| | | | | |
|---|---|---|---|---|
| 2013/0147591 | A1* | 6/2013 | Kim | H01F 41/00 336/200 |
| 2014/0022690 | A1* | 1/2014 | Kim | H01G 4/12 361/301.4 |
| 2015/0043185 | A1* | 2/2015 | Ahn | H01G 4/01 361/767 |
| 2015/0048915 | A1 | 2/2015 | Yoon et al. | |
| 2015/0287516 | A1* | 10/2015 | Park | H01F 27/292 29/602.1 |
| 2015/0371780 | A1* | 12/2015 | Moon | H05K 1/181 361/767 |
| 2016/0086714 | A1* | 3/2016 | Moon | H01F 27/255 336/200 |
| 2016/0189850 | A1* | 6/2016 | Lee | H01F 27/292 336/200 |
| 2016/0234979 | A1 | 8/2016 | Lee et al. | |
| 2016/0268038 | A1* | 9/2016 | Choi | H01F 27/255 |
| 2017/0032883 | A1* | 2/2017 | Hong | H01F 41/046 |
| 2018/0166211 | A1* | 6/2018 | Takatsuji | H02M 1/143 |
| 2019/0066900 | A1* | 2/2019 | Nakajima | H01F 41/041 |
| 2019/0189338 | A1* | 6/2019 | Kim | H01F 17/04 |
| 2019/0362887 | A1 | 11/2019 | Fang et al. | |
| 2020/0020477 | A1 | 1/2020 | Kang et al. | |

FOREIGN PATENT DOCUMENTS

| | | | |
|---|---|---|---|
| KR | 10-2015-0019730 | A | 2/2015 |
| KR | 10-2016-0098780 | A | 8/2016 |
| KR | 10-2019-0135165 | A | 12/2019 |
| KR | 10-2020-0006450 | A | 1/2020 |

* cited by examiner

COIL COMPONENT

CROSS-REFERENCE TO RELATED APPLICATION(S)

The present application claims the benefit of priority to Korean Patent Application No. 10-2020-0083863, filed on Jul. 8, 2020 in the Korean Intellectual Property Office, the entire disclosure of which is incorporated herein by reference.

TECHNICAL FIELD

The present disclosure relates to a coil component.

BACKGROUND

An inductor, a coil component, is a typical passive electronic component used in electronic devices, along with a resistor and a capacitor.

As electronic devices gradually gain higher performance and become smaller, the number of electronic components used in electronic devices is increased, while being miniaturized.

Conventionally, an external electrode of a coil component is formed by applying a conductive paste to both end surfaces, opposing each other in a length direction of a component body, and curing the applied conductive paste. In this case, overall thickness of the coil component may be increased. When a component, on which the above-described external electrode is formed, is mounted on a substrate, a coupling member such as a solder, or the like, is formed on a mounting surface of the substrate to extend from the component in a width direction and a length direction of the component, and thus, an effective mounting area is increased.

SUMMARY

An aspect of the present disclosure is to provide a coil component, capable of achieving lightness and compactness.

Another aspect of the present disclosure is to provide a coil component, capable of reducing an effective mounting area.

According to an aspect of the present disclosure, a coil component includes a body, a coil portion disposed inside the body, a first external electrode and a second external electrode disposed to be spaced apart from each other on one surface of the body and connected to the coil portion, a first insulating layer and a second insulating layer respectively connected to the one surface of the body, respectively disposed to both side surfaces of the body, opposing each other, to extend upwardly of the one surface of the body, and a third insulating layer and a fourth insulating layer respectively connected to the one surface of the body, respectively disposed on both end surfaces of the body, opposing each other, and each extending upwardly of the one surface of the body. A portion of each of the first and second external electrodes, exposed from the first to fourth insulating layers, is spaced apart from each of a plurality of edges of the one surface of the body on the one surface of the body.

According to an aspect of the present disclosure, a coil component includes a body, a coil portion disposed inside the body, a first external electrode and a second external electrode disposed to be spaced apart from each other on one surface of the body and connected to the coil portion, and a plurality of insulating layers covering a plurality of edges of the one surface of the body in such a manner that portions of the first and second external electrodes, exposed from the plurality of insulating layers , are spaced apart from each of the plurality of edges of the one surface of the body. Among the plurality of insulating layers, two insulating layers, disposed on a vertex region of the one surface of the body, overlap each other in the vertex region, and.

According to an aspect of the present disclosure, a coil component includes a body having a first surface and a second surface opposing each other in a width direction of the body, a third surface and a fourth surface opposing each other in a length direction of the body, and a fifth surface and a sixth surface opposing each other in a thickness direction of the body, a coil portion disposed inside the body, a first external electrode and a second external electrode connected to the coil portion and spaced apart from each other on the sixth surface of the body, a first insulating layer disposed on the first surface and extending onto a portion of each of the third to sixth surfaces, a second insulating layer disposed on the second surface and extending onto another portion of each of the third to sixth surfaces, a third insulating layer disposed on the third surface and extending onto a portion of each of the first, second, fifth, and sixth surfaces, and a fourth insulating layer disposed on the fourth surface and extending onto another portion of each of the first, second, fifth, and sixth surfaces.

BRIEF DESCRIPTION OF DRAWINGS

The above and other aspects, features, and advantages of the present disclosure will be more clearly understood from the following detailed description, taken in conjunction with the accompanying drawings.

DETAILED DESCRIPTION

Figure 1:
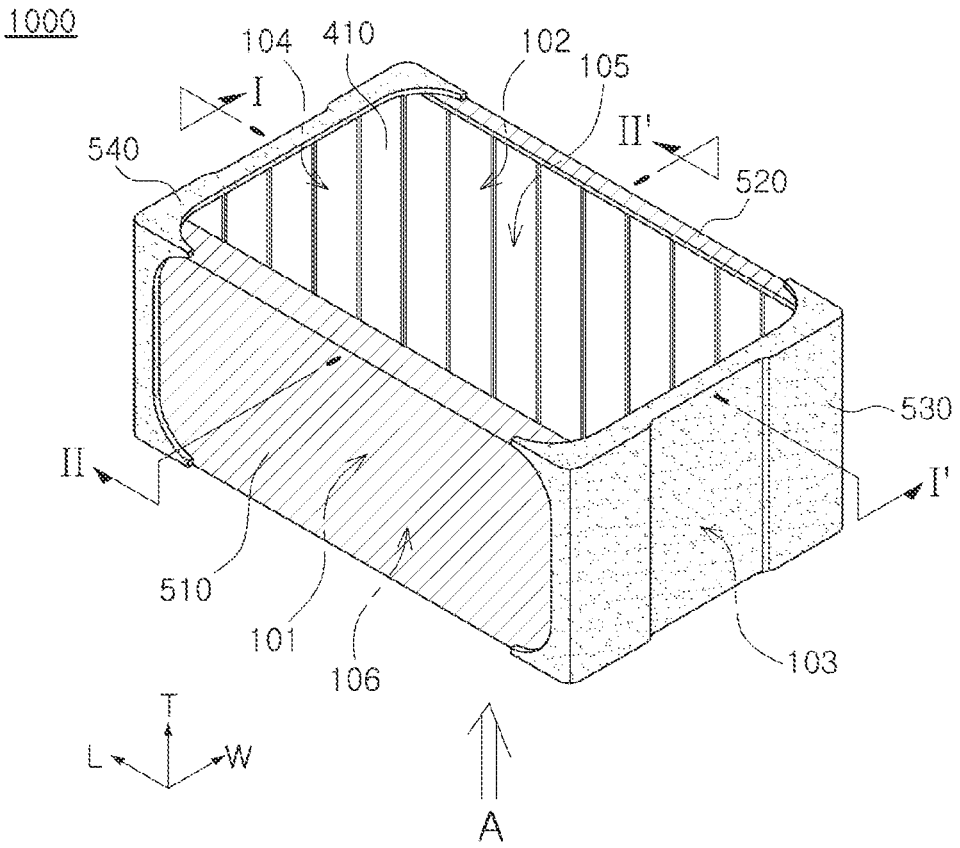
FIG. 1 is a schematic perspective view of a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
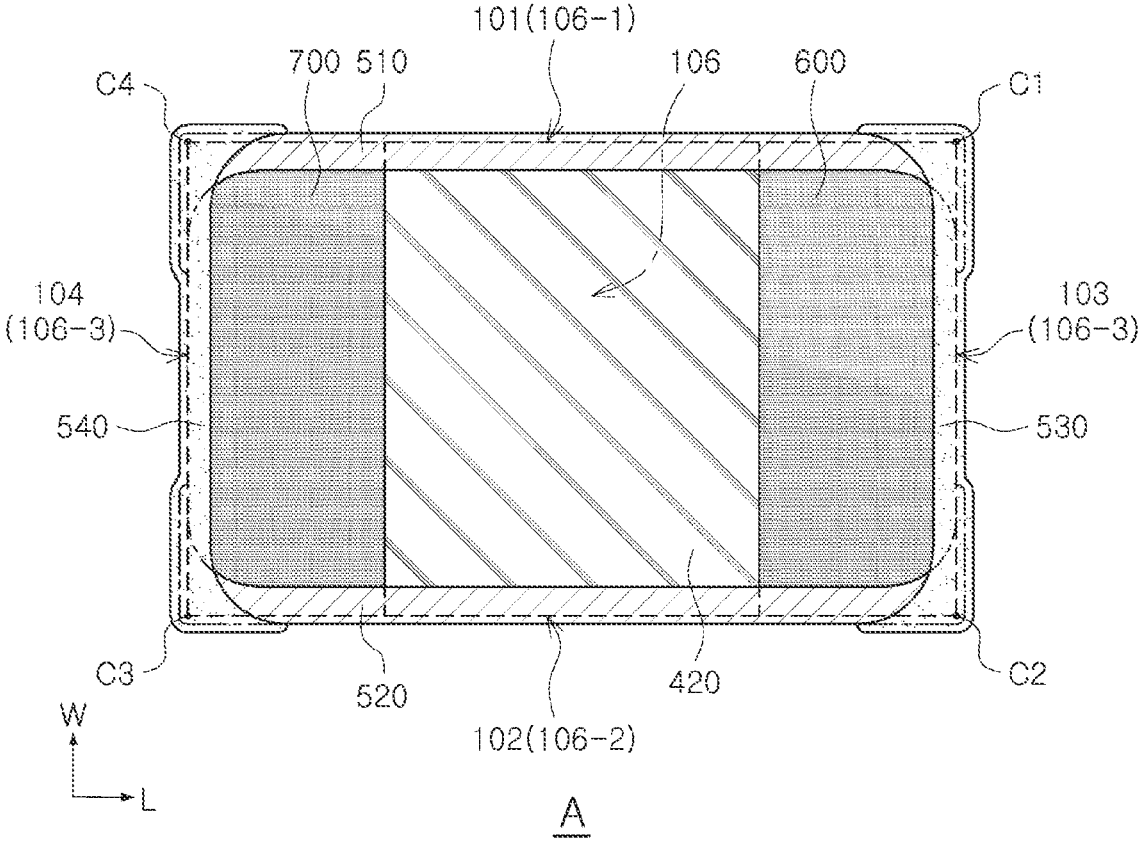
FIG. 2 is a view of a coil component according to an exemplary embodiment of the present disclosure, taken along a lower side (in direction A of FIG. 1).
Figure 3:
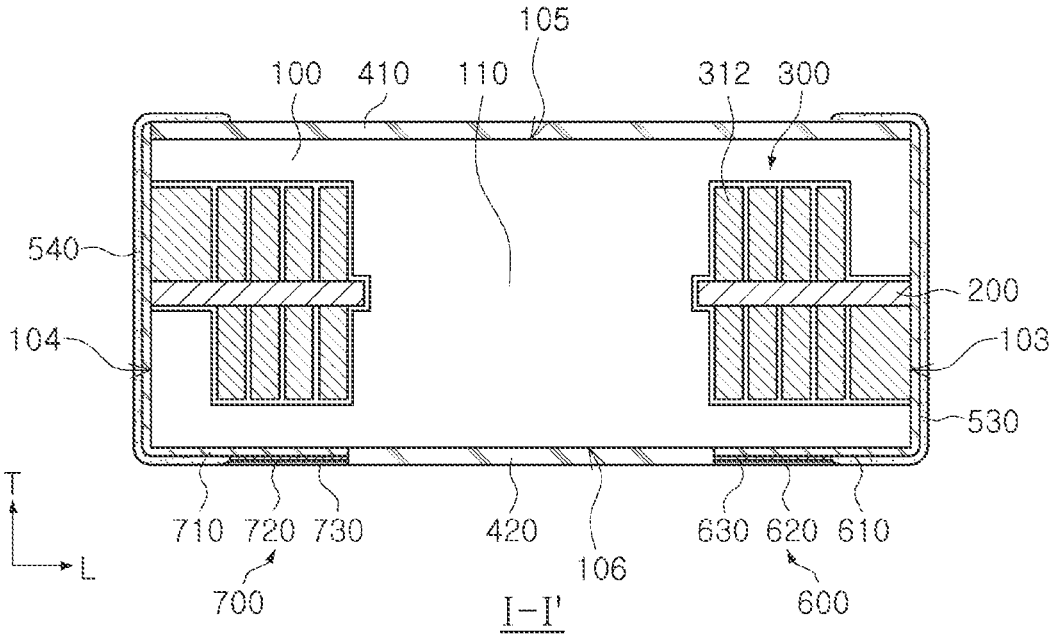
FIG. 3 is a cross-sectional view taken along line I-I' of FIG. 1.
Figure 4:
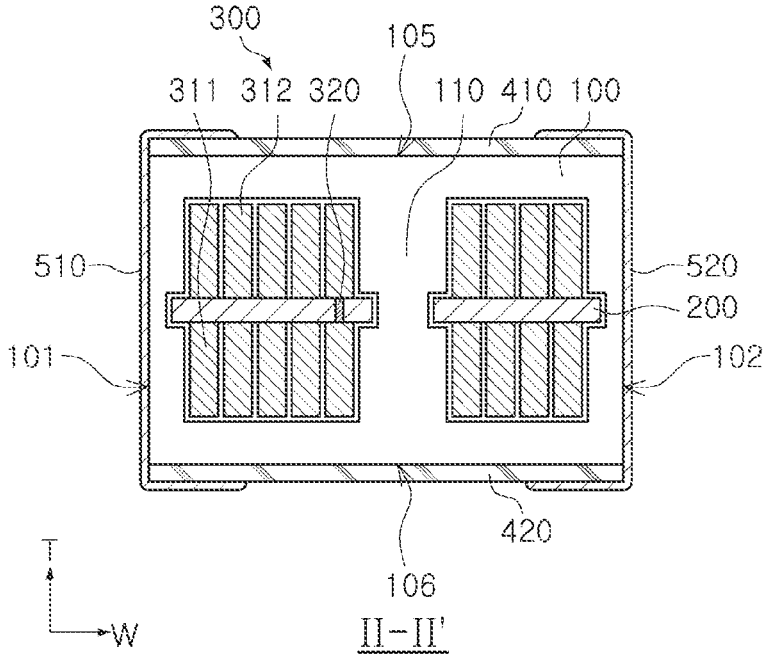
FIG. 4 is a cross-sectional view taken along line II-II' of FIG. 1.

FIG. 1 is a schematic perspective view of a coil component according to an exemplary embodiment of the present disclosure. FIG. 2 is a view of a coil component according to an exemplary embodiment of the present disclosure, taken along a lower side (in direction A of FIG. 1). FIG. 3 is a cross-sectional view taken along line I-I' of FIG. 1. FIG. 4 is a cross-sectional view taken along line II-II' of FIG. 1. FIGS. 5 to 9 are views illustrating a method of manufacturing a coil component according to an exemplary embodiment of the present disclosure.

Referring to FIGS. 1 to 4, a coil component 1000 according to an exemplary embodiment may include a body 100, a support substrate 200, a coil portion 300, an insulating layer 410, 420, 510, 520, 530, and 540, and external electrodes 600 and 700, and may further include an insulating film IF.

The body 100 may form an exterior of the coil component 1000, and the coil portion 300 and the support substrate 200 may be disposed in the body 100.

The body 100 may be formed to have a hexahedral shape overall.

The body 100 has a first surface 101 and a second surface 102 opposing each other in a width direction W, a third surface 103 and a fourth surface 104 opposing each other in a length direction L, and a fifth surface 105 and a sixth surface 106 opposing each other in a thickness direction T, based on FIGS. 1, 3, and 4. Each of the first to fourth surfaces 101, 102, 103, and 104 of the body 100 may correspond to a wall surface of the body 100 connecting the fifth surface 105 and the sixth surface 106 of the body 100. Hereinafter, both side surfaces of the body 100 may refer to the first surface 101 and the second surface 102, respectively, both end surfaces of the body 100 may refer to the third surface 103 and the fourth surface 104 of the body 100, respectively, and one surface and the other surface of the body 100 may refer to the sixth surface 106 and the fifth surface 105 of the body 100, respectively.

As an example, the body 100 may be formed in such a manner that the coil component 1000, including the external electrodes 600 and 700 and insulating layers 410, 420, 510, 520, 530, and 540 to be described later, has a length of 2.0 mm, a width of 1.2 mm, and a thickness of 0.65 mm, but the present disclosure is not limited thereto.

The term "length of the coil component 1000" may refer to, based on an optical microscope image for the coil component 1000 taken toward the fifth surface 105 of the body 100 on the fifth surface 105 of the body 100, a maximum value, among lengths of a plurality of segments connecting two boundary lines opposing each other in a length (L) direction of the body 100, among outermost boundary lines of the coil component 1000 illustrated in the image, and parallel to the length (L) direction. Alternatively, the term "length of the coil component 1000" may refer to, based on the image, a minimum value, among lengths of a plurality of segments connecting two boundary lines opposing each other in a length (L) direction, among outermost boundary lines of the coil component 1000 illustrated in the image, and parallel to the length (L) direction of the body 100. Alternatively, the term "length of the coil component 1000" may refer to an arithmetic means of at least three segments, among a plurality of segments connecting two boundary lines opposing each other in a length (L) direction, among outermost boundary lines of the coil component 1000 illustrated in the image, and parallel to the length (L) direction of the body 100.

The term "width of the coil component 1000" may refer to, based on an optical microscope image for the coil component 1000 taken toward the fifth surface 105 of the body 100 on the fifth surface 105 of the body 100, a maximum value, among lengths of a plurality of segments connecting two boundary lines opposing each other in a width (W) direction of the body 100, among outermost boundary lines of the coil component 1000 illustrated in the image, and parallel to the width (W) direction. Alternatively, the term "width of the coil component 1000" may refer to, based on the image, a minimum value, among lengths of a plurality of segments connecting two boundary lines opposing each other in a width (W) direction, among outermost boundary lines of the coil component 1000 illustrated in the image, and parallel to the width (W) direction of the body 100. Alternatively, the term "width of the coil component 1000" may refer to an arithmetic means of at least three segments, among a plurality of segments connecting two boundary lines opposing each other in a width (W) direction, among outermost boundary lines of the coil component 1000 illustrated in the image, and parallel to the width (W) direction of the body 100.

The term "thickness of the coil component 1000" may refer to, based on an optical microscope image for the coil component 1000 taken toward the first surface 101 of the body 100 on the first surface 101 of the body 100, a maximum value, among lengths of a plurality of segments connecting two boundary lines opposing each other in a thickness (T) direction of the body 100, among outermost boundary lines of the coil component 1000 illustrated in the image, and parallel to the thickness (T) direction. Alternatively, the term "thickness of the coil component 1000" may refer to, based on the image, a minimum value, among lengths of a plurality of segments connecting two boundary lines opposing each other in a thickness (T) direction, among outermost boundary lines of the coil component 1000 illustrated in the image, and parallel to the thickness (T) direction of the body 100. Alternatively, the term "thickness of the coil component 1000" may refer to an arithmetic means of at least three segments, among a plurality of segments connecting two boundary lines opposing each other in a thickness (T) direction, among outermost boundary lines of the coil component 1000 illustrated in the image, and parallel to the thickness (T) direction of the body 100.

Alternatively, each of the length, the width, and the thickness of the coil component 1000 may be measured by a micrometer measurement method. In the micrometer measurement method, measurement may be performed by setting a zero point using a micrometer with gage repeatability and reproducibility (R&R), inserting the coil component 1000 inserted between tips of the micrometer, and turning a measurement lever of the micrometer. When the length of the coil component 1000 is measured by a micrometer measurement method, the length of the coil component 1000 may refer to a value measured once or an arithmetic mean of values measured multiple times. This may be equivalently applied to the width and the thickness of the coil component 1000.

The body 100 may include a magnetic material 10 and a resin. Specifically, the body 100 may be formed by laminating at least one magnetic composite sheet in which a magnetic material is dispersed in a resin. However, the body 100 may have a structure other than the structure in which a magnetic material is dispersed in a resin. For example, the body 100 may be formed of a magnetic material such as ferrite.

The magnetic material may be ferrite or magnetic metal powder particles.

Examples of the ferrite powder particles may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al) , niobium (Nb) , copper (Cu) , and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder particle may be amorphous or crystalline. For example, the magnetic metal powder particle may be a Fe—Si—B—Cr-based amorphous alloy powder, but is not limited thereto.

Each of the magnetic metal powder particles may have an average diameter of about 0.1 μm to 30 μm, but is not limited thereto.

The body 100 may include two or more types of magnetic metal powder particle dispersed in a resin. The term "different types of magnetic powder particle" means that the magnetic powder particles, dispersed in the resin, are distinguished from each other by at least one of average diameter, composition, crystallinity, and shape.

The resin R may include epoxy, polyimide, liquid crystal polymer, or the like, in a single form or combined forms, but is not limited thereto.

The body 100 may include a core 110 penetrating through a central portion of each of the support substrate 200 and the coil portion 300. The core 110 may be formed by filling the central portion of the coil portion 300 and the support substrate 200 with a magnetic composite sheet, but the present disclosure is not limited thereto.

The support substrate 200 may be embedded in the body 100. The support substrate 200 may support the coil portion 300 to be described later.

The support substrate 200 may include an insulating material, for example, a thermosetting insulating resin such as an epoxy resin, a thermoplastic insulating resin such as polyimide, or a photosensitive insulating resin, or the support substrate 200 may include an insulating material in which a reinforcing material such as a glass fiber or an inorganic filler is impregnated with an insulating resin. For example, the support substrate 200 may include an insulating material such as prepreg, Ajinomoto Build-up Film (ABF), FR-4, a bismaleimide triazine (BT) film, a photoimageable dielectric (PID) film, and the like, but are not limited thereto.

The inorganic filler maybe at least one or more selected from the group consisting of silica ($SiO_2$) , alumina ($Al_2O_3$), silicon carbide (SiC) , barium sulfate ($BaSO_4$) , talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$) , barium titanate ($BaTiO_3$) , and calcium zirconate ($CaZrO_3$).

When the support substrate 200 is formed of an insulating material including a reinforcing material, the support substrate 200 may provide better rigidity. When the support substrate 200 is formed of an insulating material not including glass fibers, the support substrate 200 may be advantageous in thinning the coil component 1000. In addition, the volume accounted for by the coil portion 300 and/or the magnetic material, based on the body 100 having the same size, may be increased to improve component characteristics. When the support substrate 200 is formed of an insulating material including a photosensitive insulating resin, the number of processes of forming the coil portion 300 may be reduced. Therefore, it maybe advantageous in reducing production costs, and a fine via may be formed.

The coil portion 300 is disposed inside the body 100 to express characteristics of the coil component 1000. For example, when the coil component 1000 is used as a power inductor, the coil portion 300 may store an electric field as a magnetic field to maintain an output voltage, serving to stabilize power of an electronic device.

The coil portion 300 includes coil patterns 311 and 312 and a via 320. Specifically, based on the directions of FIGS. 3 and 4, the first coil pattern 311 may be disposed on a lower surface of the support substrate 200, opposing the sixth surface 106 of the body 100, and the second coil pattern 312 may be disposed on an upper surface of the support substrate 200, opposing the lower surface of the support substrate 200. The via 320 may be connected to an internal end portion of each of the first coil pattern 311 and the second coil pattern 312 through the support substrate 200. Thus, the coil portion 300 may function as a single coil overall. An external end portion of the first coil pattern 311 may be exposed to the third surface 103 of the body 100, and an external end portion of the second coil pattern 312 may be exposed to the fourth surface 104 of the body 100. The external end portions of the first and second coil patterns 311 and 312, exposed to the third and fourth surfaces 103 and 104 of the body 100, may be in contact with and connected to first electrode layers 610 and 710 of the external electrodes 600 and 700 to be described later, respectively.

Each of the first coil pattern 311 and the second coil pattern 312 may be in the form of a planar spiral in which at least one turn is formed around the core 110. For example, the first coil pattern 311 may form at least one turn around the core 110 on the lower surface of the support substrate 200.

At least one of the coil patterns 311 and 312 and the via 320 may include at least one conductive layer. For example, when the second coil pattern 312 and the via 320 are formed by performing a plating process on a side of the upper surface of the support substrate 200, each of the second oil pattern 312 and the via 320 may include a seed layer and an electroplating layer. Each of the seed layer and the electroplating layer may have a single-layer structure or a multi-layer structure. The electroplating layer having the multi-layer structure may have a conformal structure in which one electroplating layer covers the other electroplating layer, or may have a form in which the other electroplating layer is laminated on only one surface of the one electroplating layer. The seed layer of the second coil pattern 312 and the seed layer of the via 320 may be integrated with each other, and thus, there maybe no boundary therebetween, but are not limited thereto. The electroplating layer of the second coil pattern 312 and the electroplating layer of the via 320 may be integrated with each other, and thus, there may no boundary therebetween, but are not limited thereto.

As another example, the coil portion 300 may be formed by separately forming the first coil pattern 311 disposed on a side of the lower surface of the support substrate 200 and the second coil pattern 312 disposed on a side of the upper surface of the support substrate 200 and laminating the first coil pattern 311 and the second coil pattern 312 on the support substrate 200 in a batch. In this case, the via 320 may include a high-melting-point metal layer and a low-melting-point metal layer having a melting point lower than a melting point of the high-melting-point metal layer. The low-melting-point metal layer may be formed of a solder including lead (Pb) and/or tin (Sn). At least a portion of the low-melting-point metal layer may be melted due to pressure and temperature during the batch lamination. For this reason, an intermetallic compound layer (IMC layer) may be formed on a portion of a boundary between the low-melting-point metal layer and the second coil pattern 312, for example.

For example, the coil patterns 311 and 312 maybe formed to protrude from the lower surface and the upper surface of the support substrate 200, respectively, as illustrated in FIGS. 3 and 4. As another example, the first coil pattern 311 may be formed to protrude from the lower surface of the support substrate 200, and the second coil pattern 312 may be embedded in the upper surface of the support substrate 200 to expose the upper surface of the second coil pattern 312 to the upper surface of the support substrate 200. In this case, a concave portion may be formed on the upper surface of the second coil pattern 312, so that the upper surface of the support substrate 200 and the upper surface of the second coil pattern 312 may not be disposed on the same plane.

Each of the coil patterns 311 and 312 and the via 320 may be formed of a conductive material such as copper (Cu), aluminum (Al), silver (Ag), tin (Sn), gold (Au), nickel (Ni), lead (Pb), titanium (Ti), molybdenum (Mo), chromium (Cr), or alloys thereof, but the conductive material is not limited thereto.

The first and second insulating layers 510 and 520 may each be connected to the one surface 106 of the body 100, and may be disposed on both side surfaces 101 and 102 of the body 100, opposing each other, respectively, to extend to the one surface 106 of the body 100. The third and fourth insulating layers 530 and 540 may each be connected to the one surface 106 of the body 100, and may be disposed on both end surfaces 103 and 104 of the body 100, opposing each other, respectively, to extend to the one surface 106 of the body 100.

Specifically, the first insulating layer 510 may be disposed on the first surface 101 of the body 100, and may extend to the sixth surface 106 of the body 100 to cover an edge 106-1 between the first surface 101 and the sixth surface 106 of the body 100. As a result, the first insulating layer 510 may cover a first vertex region C1 and a fourth vertex region C4 of the sixth surface 106 of the body 100. The second insulating layer 520 may be disposed on the second surface 102 of the body 100, and may extend to the sixth surface 106 of the body 100 to cover a second edge 106-2 between the second surface 102 and the sixth surface 106 of the body 100. Asa result, the second insulating layer 520 may cover a second vertex region C2 and a third vertex region C3 of the sixth surface 106 of the body 100. The third insulating layer 530 may be disposed on the third surface 103 of the body 100, and may extend to the sixth surface 106 of the body 100 to cover a third edge 106-3 between the third surface 103 and the sixth surface 106 of the body 100. As a result, the third insulating layer 530 may cover the first and second vertex regions C1 and C2 of the sixth surface 106 of the body 100. The fourth insulating layer 540 may be disposed on the fourth surface 103 of the body 100, and may extend to the sixth surface 106 of the body to cover a fourth edge 106-4 between the fourth surface 104 and the sixth surface 106 of the body 100. As a result, the fourth insulating layer 540 may cover the third and fourth vertex regions C3 and C4 of the sixth surface 106 of the body 100.

The first to fourth insulating layers 510, 520, 530, and 540 may form regions overlapping each other in the vertex regions C1, C2, C3, and C4 of one surface 106 of the body 100. For example, in the first vertex region C1, the third insulating layer 530 may be disposed on the first insulating layer 510 to form a region in which they overlap each other. In the second vertex region C2, the third insulating layer 530 is disposed on the second insulating layer 520 to form an overlapped region. In the third vertex region C3, the fourth insulating layer 540 may be disposed on the second insulating layer 520 to form a region in which they overlap each other. In the fourth vertex region C4, the fourth insulating layer 540 may be disposed on the first insulating layer 510 to form a region in which they overlap each other. In this specification, the term "edge" may refer to a boundary formed by two connected surfaces of the body 100. In addition, in the present specification, the term "vertex region" may refer to a boundary region formed by three connected surfaces of the body 100, and may not match a vertex in mathematical meaning.

In this embodiment, since a plurality of edges 106-1, 106-2, 106-3, and 106-4 of the sixth surface 106 of the body 100 and a plurality of vertex regions C1, C2, C3, and C4 are covered with the first to fourth insulating layers 510, 520, 530, and 540, they are not exposed to an external entity. In general, in an edge and a vertex region, boundaries between surfaces of a body, there is a high probability that cracking is present and there is high probability that the conductive magnetic metal powder particles are exposed. The cracking and the exposed magnetic metal powder particle may serve as a transmission path of leakage current, and may cause an electrical short-circuit between external electrodes of a component to deteriorate component characteristics. In this embodiment, the edges 106-1, 106-2, 106-3, and 106-4 and the vertex regions C1, C2, C3, and C4 of the sixth surface 106 of the body 100 may all be covered with the first to fourth insulating layers 510, 520, 530, and 540 to address the above-mentioned issue. In particular, each of the vertex regions C1, C2, C3, and C4 of the sixth surface 106 of the body 100, having a relatively high probability of the presence of cracking and the presence of the exposed magnetic metal powder particles, maybe doubly covered with the insulating layers 510, 520, 530, and 540 to improve the above-described improvement.

A length of each of the first and second insulating layers 510 and 520 in the second direction Won one surface 106 of the body 100 is greatest on both end portions of each of the first and second insulating layers 510 and 520 in the first direction L. A length of each of the third and fourth insulating layers 103 and 104 in the first direction L on the one surface 106 of the body 100 is greatest on both end portions of each of the third and fourth insulating layers 103 and 104 in the second direction W. Specifically, a length of the first insulating layer 510 in the width direction W on the sixth surface 106 of the body 100 is greatest in the first and fourth vertex regions C1 and C4, both end portions of the second insulating layer 520 in the length direction L. A length of the second insulating layer 520 in the width direction Won the sixth surface 106 of the body 100 is greatest in the second and third vertex regions C2 and C3, both end portions of the second insulating layer 520. A length of the third insulating layer 530 in the length direction L on the sixth surface 106 of the body 100 is greatest in the first and second vertex regions C1 and C2, both end portions of the third insulating layer 530 in the width direction W. A length of the fourth insulating layer 540 in the length direction L on the sixth surface 106 of the body 100 is greatest in the third and fourth vertex regions C3 and C4, both end portions of the fourth insulating layer 510 in the width direction W. In general, external stress is concentrated on an edge region of a component to cause cracking to extend relatively long. In this embodiment, each of the first to fourth insulating layers 510, 520, 530, and 540 may be formed to be longer than other regions in the vertex regions C1, C2, C3, and C4 to more efficiently prevent characteristics of a component from being deteriorated by the cracking.

According to the above-described structure, the first to fourth insulating layers 510, 520, 530, and 540 are formed to expose one region of the sixth surface 106 of the body 100. The external electrodes 600 and 700 to be described later may be formed to be spaced apart from each other in the exposed region of the sixth surface 106. For the above-mentioned reason, the external electrodes 600 and 700 may be spaced apart from each of the first to fourth edges 106-1, 106-2, 106-3, and 106-4. In addition, for the above-mentioned reason, distances between the external electrodes 600 and 700 and the first to fourth edges 106-1, 106-2, 106-3, and 106-4 of the body 100 are greatest in the vertex regions C1, C2, C3, and C4 of the sixth surface 106. The external electrodes 600 and 700 may be spaced apart from the first to fourth edges 106-1, 106-2, 106-3, and 106-4 of the sixth surface 106 of the body 100 and distances between the external electrodes 600 and 700 and the vertex regions C1, C2, C3, and C4 may be increased, so that characteristics of a component may be prevented from being deteriorated.

The external electrodes 600 and 700 may be disposed to be spaced apart from each other on one surface 106 of the body 100, and may be connected to the coil portion 300. Each of the external electrodes 600 and 700 may include a connection portion, disposed on both end surfaces 103 and 104 of the body 100 to be in contact with and connected to both end portions of the coil portion 300, and a pad portion extending from the connection portion to the one surface 106 of the body 100. Specifically, the first electrode layer 610 of the first external electrode 600 may be disposed on the third surface 103 of the body 100 to be in contact with and connected to an outermost end portion of the first coil pattern 311 exposed to the third surface 103 of the body 100, and may extend to the sixth surface 106 of the body 100. In the first electrode 610 of the first external electrode 600, a region disposed on the third surface 103 of the body 100 may correspond to the connection portion of the first external electrode 600. In the first electrode 610 of the first external electrode 600, a region disposed on the sixth surface 106 of the body 100 may correspond to the pad portion of the first external electrode 600. The second external electrode 700 may be disposed on the fourth surface 104 of the body 100 to be in contact with and connected to an outermost end portion of the second coil pattern 312 exposed to the fourth surface 104 of the body 100. In the first electrode 710 of the second external electrode 700, a region disposed on the fourth surface 104 of the body 100 may correspond to the connection portion of the second external electrode 700. In the second electrode layer 710 of the second external electrode 700, a region disposed on the sixth surface 106 of the body 100 may correspond to the pad portion of the second external electrode 700. The pad portions of the first and second external electrodes 600 and 700 may be spaced apart from each other on the sixth surface 106 of the body 100 by a lower surface insulating layer 420 to be described later. Second and third electrode layers 620, 630, 720, and 730 may be further disposed on each region disposed on the sixth surface 106 of the body 100 in the first electrode layers 610 and 710. In this case, the pad portions of the external electrodes 600 and 700 may include second and third electrode layers 620, 630, 720, and 730.

Figure 5:
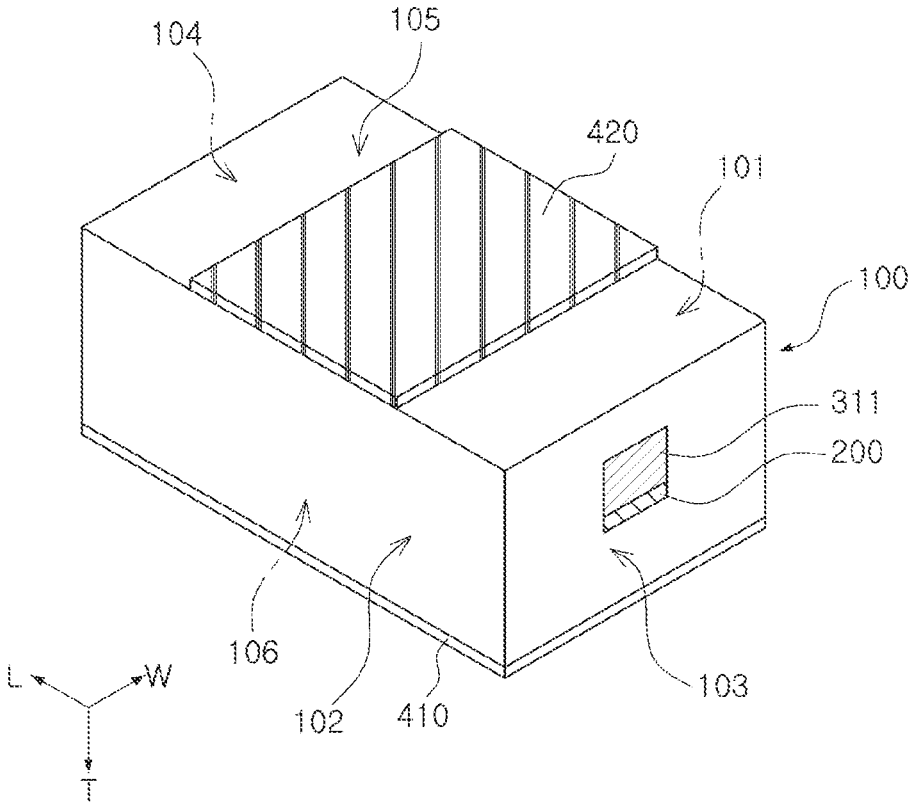
FIGS. 5 to 9 are views illustrating a method of manufacturing a coil component according to an exemplary embodiment of the present disclosure.
Figure 6:
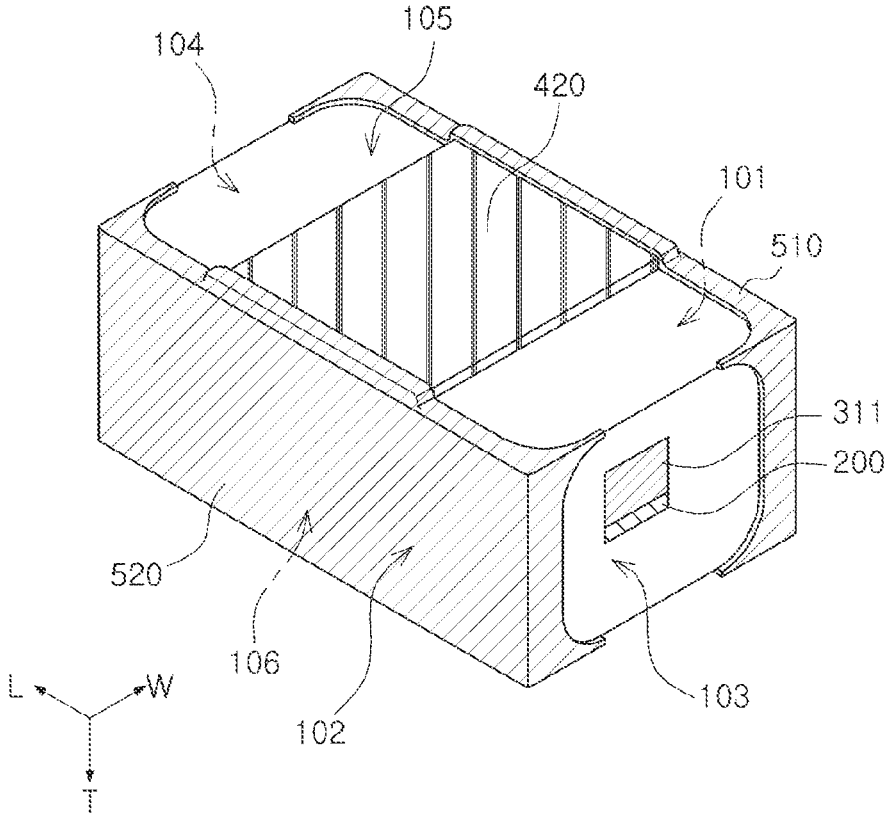
Figure 7:
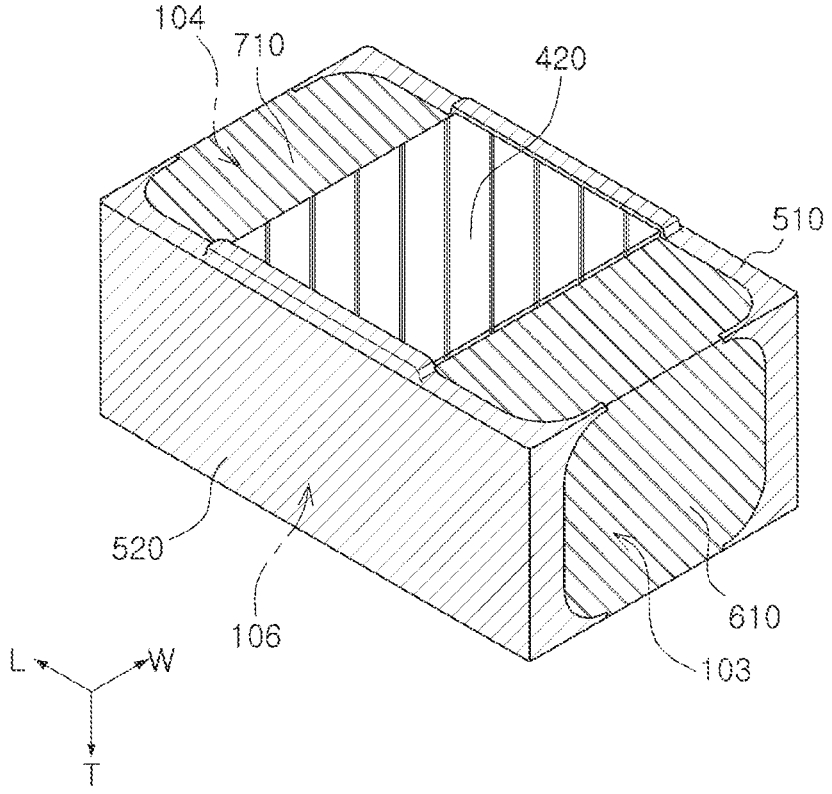
Figure 8:
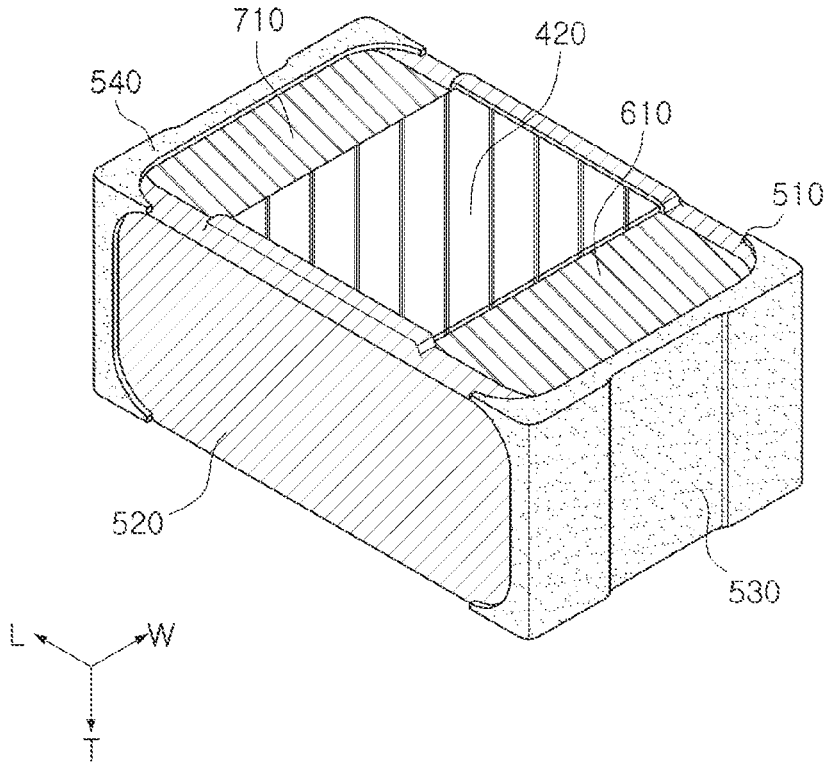
Figure 9:
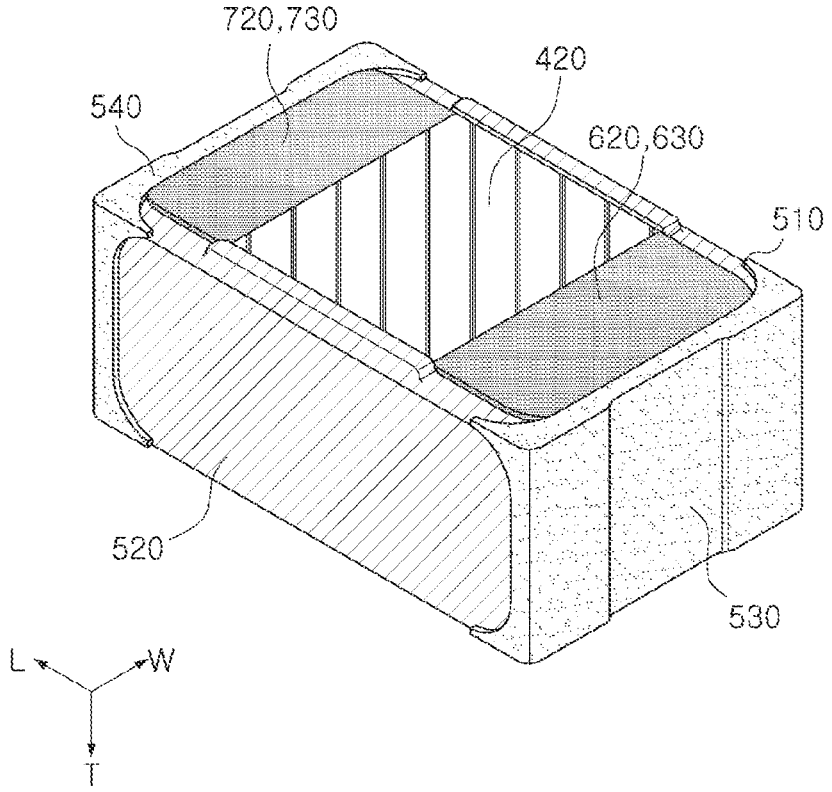

Regions of the first electrode layers 610 and 710, the connection portions of the external electrodes 600 and 700, may be covered with the third and fourth insulating layers 530 and 540 disposed on the third and fourth surfaces 103 and 104 of the body 100. Referring to FIGS. 5 to 7, the first electrode layers 610 and 710 may be formed after respectively forming an upper insulating layer 410 and a lower insulating layer 420 on the fifth surface 105 and the sixth surface 106 of the body 100 and respectively forming a first insulating layer 510 and a second insulating layer 520 on the first surface 101 and the second surface 102 of the body. In this case, the first insulating layer 510 may be formed to extend upwardly of not only the first surface 101 of the body 100 but also at least a portion of each of the third to sixth surfaces 103, 104, 105, and 106 connected to the first surface 101. The second insulating layer 520 may be formed to extend upwardly of not only the second surface 102 of the body 100 but also at least a portion of each of the third to sixth surfaces 103, 104, 105, and 106 connected to the second surface 102. Accordingly, the connection portions of the external electrodes 600 and 700 may be formed on each of the third and fourth surfaces 103 and 104 of the body 100, but may not extend to an edge between the third surface 103 and each of the first and second surfaces 101 and 102 and an edge between the fourth surface 104 and each of the first and second surfaces 101 and 102. Since the connection portions of the external electrodes 600 and 700 may not extend to an edge between the third surface 103 and each of the first and second surfaces 101 and 102 and an edge between the fourth surface 104 and each of the first and second surfaces 101 and 102, short-circuit caused by leakage current may be prevented and deterioration in characteristics of a component may be prevented.

The external electrodes 600 and 700 may be formed by vapor deposition such as sputtering, or the like, and/or plating. However, the present disclosure is not limited thereto, and the external electrodes 600 and 700 may be formed by applying a conductive resin including conductive powder particles such as copper (Cu) to a surface of the body 100 and curing the applied conductive resin.

The external electrodes 600 and 700 may be formed of a conductive material such as copper (Cu), aluminum (Al), silver (Ag), tin (Sn), gold (Au), nickel (Ni), lead (Pb), chromium (Cr), titanium (Ti), or alloys thereof, but the present disclosure is not limited thereto. The external electrodes 600 and 700 may be formed to have a single-layer structure or a multilayer structure. As an example, the external electrodes 600 and 700 include first electrode layers 610 and 710 including copper (Cu), second electrode layers 620 and 720 including nickel (Ni), and third electrodes 630 and 730 including tin (Sn), but the present disclosure is not limited thereto.

The second and third electrode layers 620, 630, 720, and 730 may be disposed on only the sixth surface 106 of the body 100. The second and third electrode layers 620, 630, 720, and 730 may be formed after sequentially forming the upper insulating layer 410 and the lower insulating layer 420, the first and second insulating layers 510 and 520, and the first electrode layers 610 and 620 in the above-mentioned order and then forming the third and fourth insulating layers 530 and 540 on the third and fourth surfaces 103 and 104 of the body 100. When the third and fourth insulating layers 530 and 540 are formed on the surface of the body 100, the surface of the body 100 may be entirely covered with the upper insulating layer 410 and the lower insulating layer 420, the first to fourth insulating layers 510, 520, 530, and 540, and the first electrode layers 610 and 710. In addition, the first electrode layers 610 and 710 may be exposed in such a manner that they are spaced apart from each other on only the sixth surface 106 of the body 100 by the upper insulating layer 410 and the lower insulating layer 420 and the first to fourth insulating layers 510, 520, 530 and 540. Since the second and third electrode layers 620, 630, 720, and 730 are formed in this state, the second and third electrode layers 620, 630, 720, and 730 may be disposed on only the sixth surface 106 of the body 100.

An insulating film IF may be disposed between the coil portion 300 and the body 100 and between the support substrate 200 and the body 100. The insulating film IF may be formed along surfaces of the support substrate 200 and the coil portion 300, but the present disclosure is not limited thereto. The insulating film IF may be provided to insulate the coil portion 300 and the body 100 from each other and may include a known insulating material such as parylene, but the present disclosure is not limited thereto. As another example, the insulating film IF may include an insulating material such as an epoxy resin other than parylene. The insulating film IF may be formed by a vapor deposition method, but the present disclosure is not limited thereto. As another example, the insulating film IF may be formed by laminating an insulating film for forming the insulating film IF on both surfaces of the support substrate 200, on which the coil portion 300 is formed, and curing the laminated insulating film. Alternatively, the insulating film IF may be formed by applying an insulating paste for forming the insulating film IF to both surfaces of the support substrate 200, on which the coil portion 300 is formed, and curing the applied insulating paste.

While the exemplary embodiment of the present disclosure has been described based on the support substrate 200 and the coil portion 300 formed on the support substrate 200 by plating, the scope of the present disclosure is not limited thereto. For example, in another exemplary embodiment of the present disclosure, a winding coil formed by winding a metal wire having an insulation-coated surface may be used as a coil portion. In this case, the above-described support substrate 200 and insulating film IF may be omitted in the corresponding exemplary embodiment.

As described above, according to an exemplary embodiment, a size of a coil component may be reduced.

According to an exemplary embodiment, an effective mounting area of a coil component may be reduced.

While exemplary embodiments have been shown and described above, it will be apparent to those skilled in the art that modifications and variations could be made without departing from the scope of the present disclosure as defined by the appended claims.

What is claimed is:

1. A coil component comprising:

a body;

a coil portion disposed inside the body;

a first external electrode and a second external electrode disposed to be spaced apart from each other on one surface of the body and connected to the coil portion;

a first insulating layer and a second insulating layer respectively disposed on side surfaces of the body and each extending to be on the one surface of the body, the side surfaces of the body connected to the one surface of the body, respectively, and opposing each other; and a third insulating layer and a fourth insulating layer respectively disposed on end surfaces of the body and each extending to be on the one surface of the body, the end surfaces of the body connected to the one surface of the body, respectively, and opposing each other, wherein a portion of each of the first and second external electrodes, exposed from the first to fourth insulating layers, is spaced apart from each of a plurality of edges of the one surface of the body on the one surface of the body.

2. The coil component of claim 1, wherein a distance from each of the plurality of edges of the one surface of the body to the first and second external electrodes is greatest in a vertex region of the one surface of the body.

3. The coil component of claim 1, wherein two among the first to fourth insulating layers overlap each other in a vertex region of the one surface of the body.

4. The coil component of claim 3, wherein in the overlapping region, the third insulating layer or the fourth insulating layer is disposed on at least a portion of the first insulating layer or the second insulating layer on the vertex region of the one surface of the body.

5. The coil component of claim 1, wherein the end surfaces of the body oppose each other in a first direction, and the side surfaces of the body oppose each other in a second direction, perpendicular to the first direction, and a length of each of the first and second insulating layers in the second direction on the one surface of the body is greatest on both end portions of each of the first and second insulating layers in the first direction.

6. The coil component of claim 1, wherein the end surfaces of the body oppose each other in a first direction, and the side surfaces of the body oppose each other in a second direction, perpendicular to the first direction, and a length of each of the third and fourth insulating layers in the first direction on the one surface of the body is greatest on both end portions of each of the third and fourth insulating layers in the second direction.

7. The coil component of claim 1, further comprising:

a fifth insulating layer disposed between the first and second external electrodes on the one surface of the body, wherein each of the first and second insulating layers is disposed on at least a portion of the fifth insulating layer.

8. The coil component of claim 1, wherein end portions of the coil portion are respectively exposed to the end surfaces of the body, and each of the first and second external electrodes includes a connection portion, disposed on one of the end surfaces of the body to be in contact with and connected to one of the end portions of the coil portion, and a pad portion extending from the connection portion to the one surface of the body.

9. The coil component of claim 8, wherein the third and fourth insulating layers respectively cover the connection portions respectively disposed on the end surfaces.

10. The coil component of claim 8, wherein the first and second insulating layers respectively extend to the end surfaces of the body in such a manner that the connection portion of each of the first and second insulating layers is spaced apart from an edge of one of the end surface of the body and one of the side surfaces of the body.

11. The coil component of claim 1, further comprising:

a support substrate disposed inside the body, wherein the coil portion includes a first coil pattern disposed on one surface of the support substrate, a second coil pattern disposed on the other surface of the support substrate opposing the one surface of the support substrate, and a via penetrating through the support substrate to connect the first and second coil patterns to each other.

12. A coil component comprising:

a body;

a coil portion disposed inside the body;

a first external electrode and a second external electrode disposed to be spaced apart from each other on one surface of the body and connected to the coil portion; and a plurality of insulating layers covering a plurality of edges of the one surface of the body in such a manner that portions of the first and second external electrodes, exposed from the plurality of insulating layers, are spaced apart from each of the plurality of edges of the one surface of the body, wherein among the plurality of insulating layers, two insulating layers, disposed on a vertex region of the one surface of the body, overlap each other in the vertex region.

13. The coil component of claim 12, wherein each of the plurality of insulating layers has a greatest width in the vertex region.

14. A coil component comprising:

a body having a first surface and a second surface opposing each other in a width direction of the body, a third surface and a fourth surface opposing each other in a length direction of the body, and a fifth surface and a sixth surface opposing each other in a thickness direction of the body;

a coil portion disposed inside the body;

a first external electrode and a second external electrode connected to the coil portion and spaced apart from each other on the sixth surface of the body;

a first insulating layer disposed on the first surface and extending onto a portion of each of the third to sixth surfaces;

a second insulating layer disposed on the second surface and extending onto another portion of each of the third to sixth surfaces;

a third insulating layer disposed on the third surface and extending onto a portion of each of the first, second, fifth, and sixth surfaces; and a fourth insulating layer disposed on the fourth surface and extending onto another portion of each of the first, second, fifth, and sixth surfaces.

15. The coil component of claim 14, wherein each of the third and fourth insulating layers overlaps a portion of the first insulating layer on the sixth surface, and each of the third and fourth insulating layers overlaps a portion of the second insulating layer on the sixth surface.

16. The coil component of claim 14, wherein an overlapped portion of the third insulating layer and the first insulating layer, an overlapped portion of the fourth insulating layer and the first insulating layer, an overlapped portion of the third insulating layer and the second insulating layer, an overlapped portion of the fourth insulating layer and the second insulating layer are respectively disposed on vertex regions of the sixth surface.

17. The coil component of claim 14, wherein the first external electrode includes a first connection portion disposed on the third surface of the body to connect to one end portion of the coil portion, and a first pad portion extending from the first connection portion to the sixth surface of the body, and the second external electrode includes a second connection portion disposed on the fourth surface of the body to connect to another end portion of the coil portion, and a second pad portion extending from the second connection portion to the sixth surface of the body.

18. The coil component of claim 17, wherein the first connection portion is covered by the third insulating layer, the first pad portion is exposed from the first to fourth insulating layers, the second connection portion is covered by the fourth insulating layer, and the second pad portion is exposed from the first to fourth insulating layers.

19. The coil component of claim 17, further comprising a fifth insulating layer disposed at least between the first pad portion and the second pad portion on the sixth surface.

20. The coil component of claim 17, wherein each of the first and second insulating layers covers a portion of the fifth insulating layer on the sixth surface.

* * * * *